US005673864A

United States Patent [19]

Stevenson et al.

[11] Patent Number: 5,673,864

[45] Date of Patent: Oct. 7, 1997

[54] CEREAL MILLING MACHINE

[75] Inventors: Paul Stevenson, Stockport; John Charles Greenwood Jagger, Hale; Christopher Coupe Harris, Shrewsbury, all of England

[73] Assignee: Satake UK Limited, Cheshire, England

[21] Appl. No.: 541,893

[22] Filed: Oct. 10, 1995

[30] Foreign Application Priority Data

Oct. 11, 1994 [GB] United Kingdom ..... 9420474

[51] Int. Cl.[6] ..... B02C 4/32

[52] U.S. Cl. ..... 241/231; 241/232; 241/234

[58] Field of Search ..... 241/37, 232, 233, 241/234, 231, 230

[56] References Cited

U.S. PATENT DOCUMENTS

| | | | |
|---|---|---|---|
| 3,107,869 | 10/1963 | McIntire | 241/232 |
| 4,154,408 | 5/1979 | Boling | 241/232 X |

FOREIGN PATENT DOCUMENTS

| | | | |
|---|---|---|---|
| 111344 | 8/1925 | Switzerland | 241/232 |
| 2029263 | 3/1980 | United Kingdom | 241/232 |
| 13857 | 7/1993 | WIPO | 241/232 |

*Primary Examiner*—Mark Rosenbaum

*Attorney, Agent, or Firm*—Nies, Kurz, Bergert & Tamburro

[57] ABSTRACT

A cereal milling machine comprising a base frame (100) to be fixedly mounted on a mill floor and at least one removable roll pack consisting of a pair of rolls (2, 4) mounted in fixed and movable bearing housing (1, 5) respectively and rotatable to form a milling nip. The movable roll bearing housing (5) is pivotally attached at (6) to the fixed bearing housing (1), and an adjustable loading means comprises a handwheel (11) connected via a lever (12), a pneumatic cylinder (13), a lever (9), an eccentric pivot (10) and a top link (7), to the movable bearing housing (5) thus to provide fine adjustment of the milling gap. With this adjustment established the rolls may be thrown in and out of grinding relationship by expanding and contracting the pneumatic cylinder (13). Thus the roll pack combines the micro-adjustment of the milling gap with an engage/disengage mechanism by way of a single compact expandable link in the form of the cylinder (13), and the handwheel assembly (11).

8 Claims, 2 Drawing Sheets

CEREAL MILLING MACHINE

Figure 1:
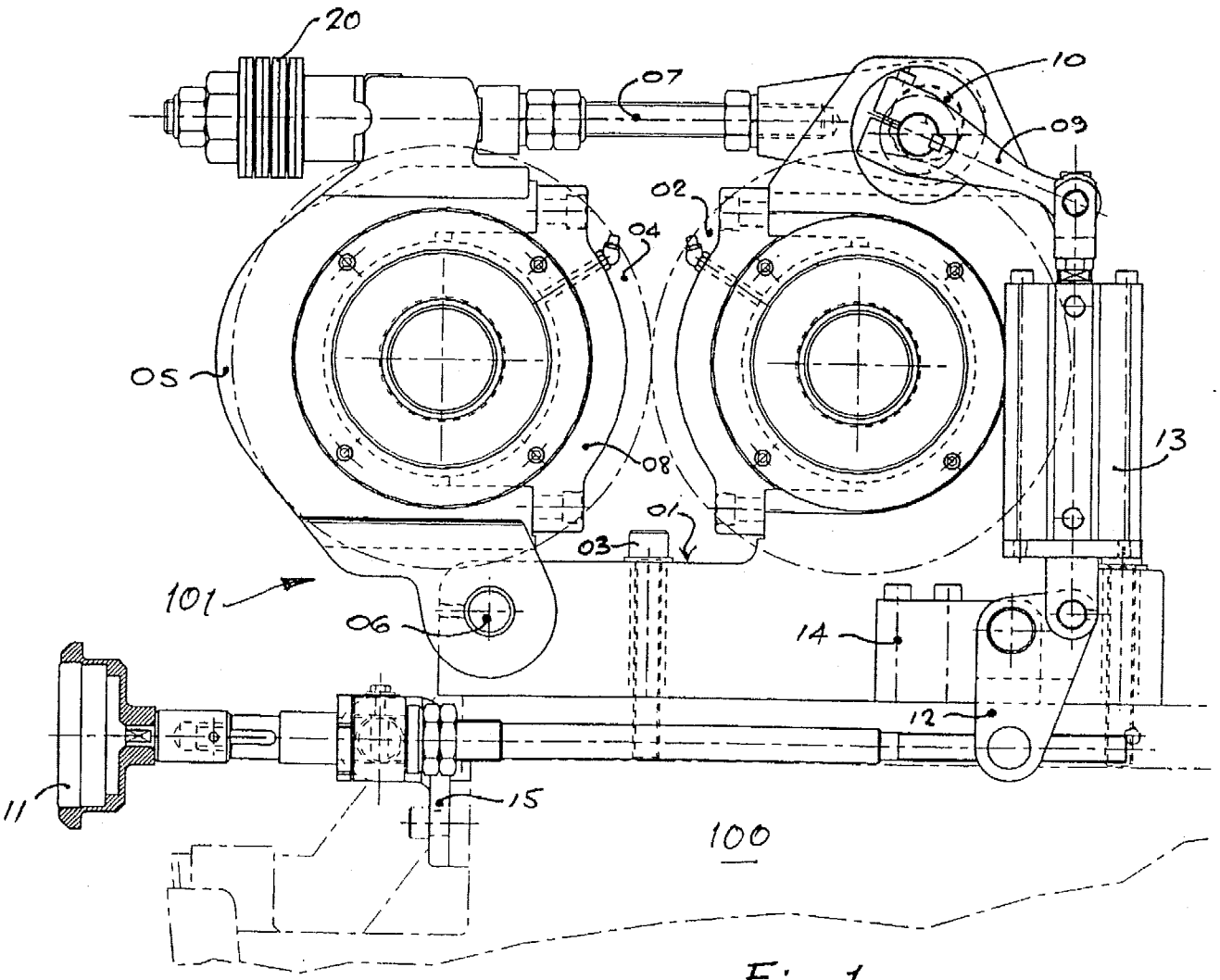

THIS INVENTION concerns a cereal milling machine, for use in the production of, for example, flour and essentially comprising a base frame to be fixedly mounted on a mill floor, and at least one pair of rolls mounted on the base frame in mutually parallel relationship to form a milling nip between the rolls.

Usually in such machines one roll of the pair is in a fixed disposition on the base frame while the other is movably mounted thereon thus to adjust and indeed separate the mutually adjacent roll surfaces to satisfy operative and inoperative conditions in the machine and to adjust the milling nip. The requirement for rapid machine maintenance and minimal down time to meet modern production rates has created a certain design of such machines in which a roll pack is mounted as a pre-assembled module on the base frame and is readily removable therefrom without the need for separate removal of the constituent parts. In this way, a roll pack may be removed and replaced with one containing rolls adapted to perform a different function. Similarly, when rolls require maintenance or repair, the pack can easily be removed and replaced with minimal loss of milling production.

In the construction of such a pre-assembled module it is usual to provide means on the roll pack for accurately adjusting the milling nip, and separate means for engaging and disengaging the rolls to place them in their operative and inoperative conditions respectively.

It is an object of the present invention to provide a cereal milling machine generally of the type hereinbefore described but including a common adjustment and engage/disengage mechanism thus minimising the number of components and the mechanical mutual interaction thereof.

According to the present invention there is provided a cereal milling machine comprising a base frame to be fixedly mounted on a mill floor; at least one roll pack removably mounted as a pre-assembled module on the base frame and consisting of a pair of rolls mounted in bearing housings for rotation in parallel relationship to form a milling nip, one pair of said bearing housings being fixed with respect to the base frame and the other pair being movably mounted with respect thereto thus to enable movement of one roll relative to the other for adjustment of the milling nip, and adjustable loading means operative between the bearing housings to contain the roll separating forces; and means for supplying stock to the milling nip, and for collecting milled stock therefrom; the roll pack being removable from the base frame while maintaining an established milling nip adjustment; characterised in that the adjustable loading means is operable on the roll pack selectively to adjust the milling nip and to enable separation and re-engagement of the rolls while maintaining an established milling nip adjustment.

Preferably said adjustable loading means includes an expandable link which when expanded serves to separate the rolls and which when subsequently retracted serves to re-engage the rolls with said established milling nip adjustment.

Figure 2:
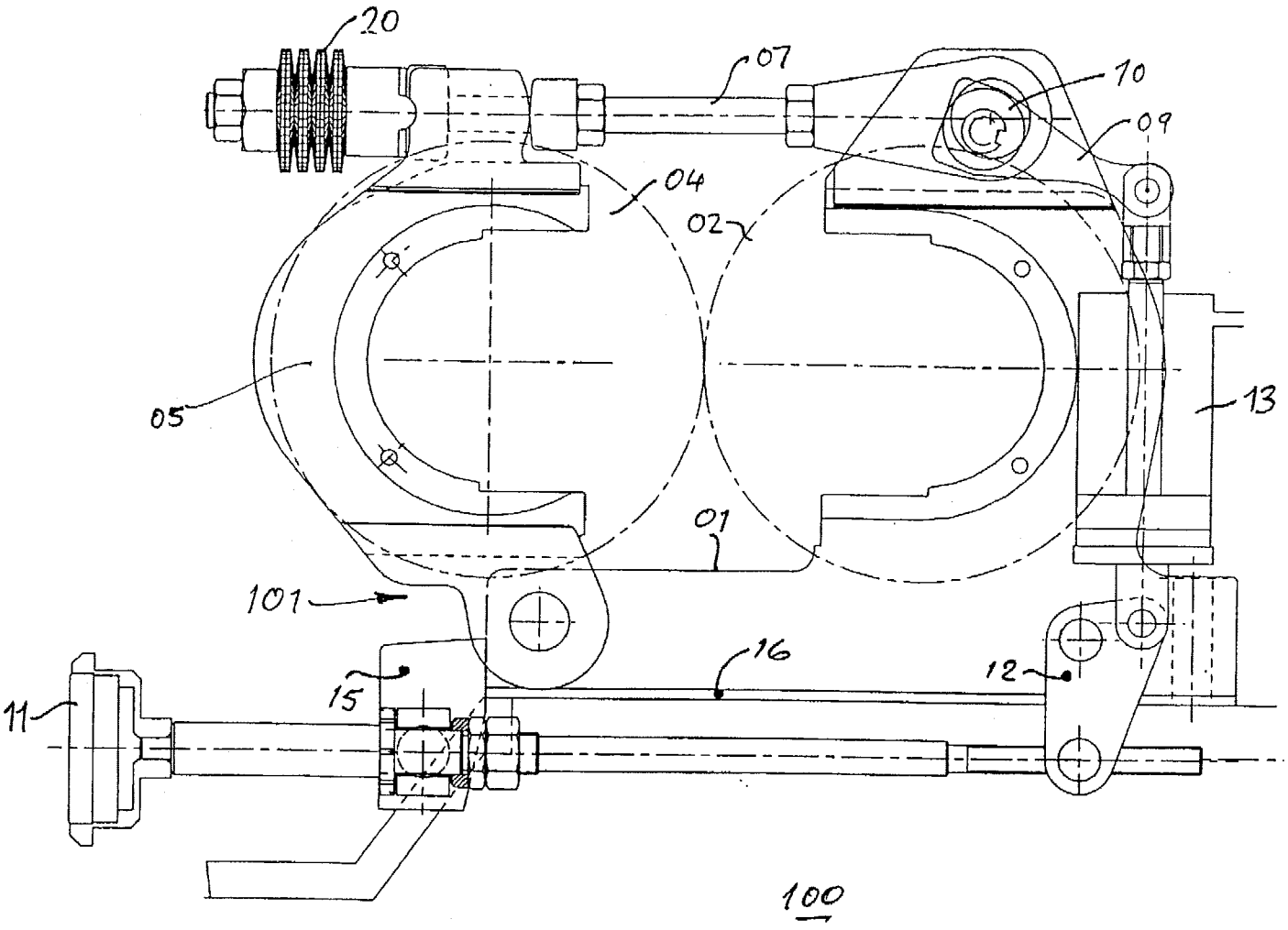

Embodiments of the invention will now be described, by way of example only, with reference to the accompanying drawings, in which:

FIG. 1 is a partial end view of a cereal milling machine constructed in accordance with one embodiment of the invention;

and FIG. 2 is a similar view of a second embodiment with some detailed parts omitted for clarity.

Referring now to FIG. 1, the machine comprises a base frame 100 upon which is mounted one or more pre-assembled modular roll packs as generally indicated at 101. Each roll pack 101 supports a pair of rolls arranged in parallel relationship to form a milling nip and includes at each end of the pair of rolls a fixed bearing housing 1 rotatably supporting, in this example, the slower moving roll 2, the other roll 4 rotating as usual in an opposite direction at a slightly faster speed to provide a milling action. The fixed housing 1 is bolted at 3 to the base frame 100.

The faster roll 4 is mounted at each end in a movable bearing housing 5 which is pivotally attached at 6 to the fixed bearing housing 1. The two bearing housings at each end of the roll pack are mutually connected by a rigid link member 7 above the rolls. Thus there is formed a roll pack in which the roll separating forces are contained by and between the fixed bearing housing 1 and the link member 7, and the pack is removable in this form as a module. If required, the faster roll 4 which, in practice, wears more quickly than the slower roll 2, may, be removed separately from the roll pack without removal of the pack from the base frame.

Adjustable loading means operative between the bearing housings to contain the roll separating forces in operation and to adjust the milling nip between the roll surfaces comprises a lever 9 eccentrically mounted pivotally at 10 to one end of the top link member 7. Pivotally attached to the remote end of the lever 9 is the piston of a pneumatic cylinder 13 the opposite end of which is pivotally mounted on a lever 12 which itself is pivotally mounted on a block 14 bolted to the machine base frame 100. Also pivotally mounted on the lever 12 is one end of an adjusting screw and hand wheel assembly 11 fixedly mounted at 15 on the base frame 100. Thus, rotation of hand wheel 11, via lever 12, cylinder 13, arm 9, eccentric pivot 10 and link member 7 causes a linear movement of the latter and thus pivotal adjustment of the movable bearing housing 5 on pivot 6 relative to the fixed roll bearing housing 1, whereby the milling nip adjustment may be accurately established by an operator using feeler gauges at the nip.

Once the milling nip is adjusted in this manner the movable roll 4 may be thrown in or out of engagement with the fixed roll 2 by means of the expandable link provided by the pneumatic cylinder 13. This cylinder typically has a stroke of 100 mm and a diameter of 63 mm which, with the eccentric pivot providing a 12½:1 mechanical advantage, is sufficient to engage and disengage the rolls while maintaining the milling gap adjustment provided by the hand wheel assembly 11 and lever 12 so that when the rolls are placed in engagement for operation the established milling gap is maintained unless readjusted by the operator once again using the hand wheel assembly.

The present invention differs from the construction of conventional roll packs in combining the micro-adjustment of the milling gap with an engage/disengage mechanism by way of a single compact expandable link in the form of the cylinder 13.

Any tendency for the pneumatic cylinder 13 slightly to expand or contract in operation thus potentially losing the accuracy of the milling nip adjustment, is prevented by the 12½:1 ratio of the eccentric pivot 10 which while providing a mechanical advantage during adjustment, by pivotal movement of arm 9, creates a mechanical disadvantage applied to any forces emanating from the top link member 7.

As is common in roll assemblies of cereal milling machines a set of disc springs 20 are pre-loaded on an upper part of the movable bearing housing 8 thus providing an overload tolerance should large objects inadvertently pass through the milling nip.

Referring now to FIG. 2 in which like parts are denoted by like reference numerals, but wherein many detailed parts have been omitted for clarity, in this case, the bracket 15 carrying the hand wheel assembly, and the lever 12 operative between the latter and the cylinder 13, are mounted, not on the base frame 100, but directly on the fixed bearing housing 1 of the roll pack assembly so that separating forces established between the rolls in operation are contained within the roll pack and not transmitted to the base frame 100. Indeed it is preferable, in this embodiment, to insert an isolation pad 16 between the roll pack 101 and the base frame 100 thus to reduce transmission of vibration into the latter.

While, in the embodiment of FIG. 1, to remove the roll pack it is necessary only to separate the pivotal connection between the arm 9 and the piston of cylinder 13, in the case of FIG. 2 the entire adjustment and engage/disengage assembly is removable as part of the roll pack, it being necessary only to unbolt the fixed bearing housings 1 at the two ends of the pack, from the base frame 100.

In a further design the features of FIGS. 1 and 2 may be combined by inserting an isolation pad between the fixed bearing housing and the base frame in FIG. 1, thus to provide the relative ease of servicing of the FIG. 1 embodiment, with some vibration isolation as provided in FIG. 2.

When setting up the machine initially a "coarse" adjustment of the relative positions of two bearing housings at each end of the roll pack is made by adjusting the effective length of the top link member 7, and a "fine" adjustment is then made as described using the hand wheel 11. Until cylinder 13 is actuated to engage or disengage the rolls, it provides, in effect, a solid link connecting the hand wheel assembly 11 with the arm 9, eccentric pivot 10 and top link member 7.

Since the roll pack is pre-assembled, in the embodiment of FIG. 1 the coarse adjustment may be pre-set before the roll pack is installed on the base frame 100, and then after connection of the top pivot of cylinder 13, the fine adjustment can be made. However, in the embodiment of FIG. 2 both course and fine adjustments can be established within the entire roll pack assembly before it is mounted on the base frame and, if required, maintained after removal therefrom.

The construction of the machine is based on the principle that precision, engineered parts are used to contain and align the grinding rolls and are mounted in a fabricated structure which contains the stock to be milled and provides a framework for feeding and extracting the product. Modern fabrication techniques of laser cutting panels, N.C. bending and tabbed assembly enable the fabricated framework to be constructed with accuracy whilst avoiding the expensive machining necessary in earlier designs. The arrangement of the roll pack which contains and aligns the grinding rolls also enables it to be serviced readily as a complete module. By simply releasing the securing bolts and slackening off drive transmission belts or the like from the main machine drive, the complete module can be removed from the machine and a replacement refurbished pack inserted in a minimum period of machine down time.

We claim:

1. A cereal milling machine comprising a base frame to be fixedly mounted on a mill floor; at least one roll pack removably mounted as a pre-assembled module on the base frame and consisting of a pair of rolls mounted in bearing housings for rotation in parallel relationship to form a milling nip, one pair of said bearing housings being fixed with respect to the base frame and the other pair being movably mounted with respect thereto thus to enable movement of one roll relative to the other for adjustment of the milling nip, and adjustable loading means operative between the bearing housings to contain the roll separating forces; and means above the rolls for supplying stock to the milling nip, and below the rolls for collecting milled stock therefrom; said at least one roll pack being removable from the base frame while maintaining an established milling nip adjustment; characterized in that the adjustable loading means comprises a rigid link member connected respectively to the bearing housings above the rolls, the rigid link member being moveable to adjust the milling nip, adjusting means connected to the rigid link member for movement thereof and an expanding link connected to and between the rigid link member and the adjusting means, to enable separation and re-engagement of the rolls while maintaining an established milling gap adjustment.

2. A cereal milling machine according to claim 1, wherein the expandable link comprises a fluidic cylinder.

3. A cereal milling machine according to claim 1, wherein the fixed bearing housings support one of said rolls adapted for rotation at a first speed, the movable bearing housings being pivotally attached to the fixed bearing housings and supporting the other roll which is adapted for rotation in an opposite direction and at a different speed to provide a milling action.

4. A cereal milling machine according to claim 1, wherein the adjustable loading means includes a lever eccentrically connected pivotally to the rigid link member, and the expanding link is a fluidic cylinder pivotally attached to the lever at a remote position thereon, the cylinder being pivotally mounted on a further lever itself pivotally mounted on a block bolted to the base frame.

5. A cereal milling machine according to claim 4, wherein there is pivotally mounted on said further lever a milling nip adjusting screw and handwheel assembly fixedly mounted on said base frame.

6. A cereal milling machine according to claim 4, wherein the fluidic cylinder, with the eccentrically attached lever combine to provide a mechanical advantage in the region of 12½:1.

7. A cereal milling machine according to claim 4, wherein the fluidic cylinder is actuated pneumatically.

8. A cereal milling machine according to claim 1, wherein said adjustable loading means is rigidly mounted on the fixed bearing housing, there being an isolation pad inserted between the fixed bearing housing and said base frame to provide vibration isolation.

* * * * *